US007775002B2

(12) United States Patent
Puchniak

(10) Patent No.: US 7,775,002 B2
(45) Date of Patent: Aug. 17, 2010

(54) PORTABLE HURRICANE AND SECURITY WINDOW BARRIER

(76) Inventor: John Puchniak, 153 Andover St., Suite 107, Danvers, MA (US) 01923

( * ) Notice: Subject to any disclaimer, the term of this patent is extended or adjusted under 35 U.S.C. 154(b) by 245 days.

(21) Appl. No.: 11/982,539

(22) Filed: Nov. 2, 2007

(65) Prior Publication Data

US 2008/0127597 A1 Jun. 5, 2008

Related U.S. Application Data

(60) Provisional application No. 60/857,863, filed on Nov. 10, 2006.

(51) Int. Cl.
*E06B 3/30* (2006.01)

(52) U.S. Cl. ..... 52/202; 52/584.1; 52/656.7; 52/799.1; 49/57; 49/63; 49/463; 160/135

(58) Field of Classification Search ..... 52/202, 52/203, 656.7, 656.8, 588.1, 584.1, 799.1; 49/50, 57, 63, 67, 169, 463, 464; 160/371, 160/135; 206/325
See application file for complete search history.

(56) References Cited

U.S. PATENT DOCUMENTS

| | | | | | |
|---|---|---|---|---|---|
| 173,722 | A | * | 2/1876 | Hayes | 52/633 |
| 768,514 | A | * | 8/1904 | Christen | 52/656.7 |
| 1,121,756 | A | | 12/1914 | Patton | |
| 1,449,714 | A | * | 3/1923 | Williams | 206/509 |
| 1,581,776 | A | * | 4/1926 | Altschul | 211/4 |
| 1,661,003 | A | * | 2/1928 | Miller | 160/229.1 |
| 1,782,203 | A | * | 11/1930 | William | 160/379 |
| 1,791,676 | A | * | 2/1931 | Landine | 160/229.1 |
| 1,859,974 | A | * | 5/1932 | Kroenke | 160/97 |
| 1,902,949 | A | | 3/1933 | Condon | |
| 1,986,716 | A | * | 1/1935 | Downey | 206/511 |
| 2,053,254 | A | * | 9/1936 | Fairchild et al. | 52/799.1 |
| 2,145,431 | A | * | 1/1939 | Panza | 160/229.1 |
| 2,238,355 | A | * | 4/1941 | Whitenack | 52/601 |
| 2,294,966 | A | * | 9/1942 | Dreyfus | 428/131 |
| 2,432,047 | A | * | 12/1947 | Sterick et al. | 160/179 |
| 2,474,382 | A | * | 6/1949 | Smith | 449/42 |
| 2,699,825 | A | * | 1/1955 | Stritzler | 160/90 |
| 3,452,477 | A | * | 7/1969 | Sassano | 49/116 |
| 3,583,100 | A | * | 6/1971 | Catalano | 49/50 |
| 3,596,701 | A | * | 8/1971 | Cowan | 160/135 |
| 3,616,838 | A | | 11/1971 | Barr | |
| 3,678,558 | A | * | 7/1972 | Fredericks | 29/897.15 |
| 3,948,431 | A | * | 4/1976 | Niimi et al. | 228/173.6 |
| 4,325,203 | A | | 4/1982 | Wicks | |
| 4,384,428 | A | * | 5/1983 | Cox | 49/56 |
| 4,454,691 | A | * | 6/1984 | Mitchell | 52/202 |
| 4,523,415 | A | * | 6/1985 | Rosen | 52/220.2 |

(Continued)

FOREIGN PATENT DOCUMENTS

| | | | |
|---|---|---|---|
| JP | 9-13838 | * | 1/1997 |

(Continued)

*Primary Examiner*—Robert J Canfield
(74) *Attorney, Agent, or Firm*—Hamilton, Brook, Smith & Reynolds, P.C.

(57) ABSTRACT

An apparatus for covering an opening of a building comprising a plurality of rectangular panels. The panels are sized such that when they are stacked for storage, the panels nest together.

20 Claims, 9 Drawing Sheets

U.S. PATENT DOCUMENTS

| | | | | | |
|---|---|---|---|---|---|
| 4,790,609 | A | * | 12/1988 | Guy | 312/117 |
| 4,993,187 | A | * | 2/1991 | Schweiss et al. | 49/56 |
| 5,005,315 | A | | 4/1991 | Jackson, Jr. | |
| 5,105,868 | A | | 4/1992 | Riise | |
| 5,347,775 | A | * | 9/1994 | Santos | 52/202 |
| 5,410,841 | A | | 5/1995 | Harris et al. | |
| 5,431,210 | A | * | 7/1995 | Nelson et al. | 160/135 |
| 5,446,996 | A | | 9/1995 | Lamont | |
| 5,575,321 | A | | 11/1996 | Currier | |
| 5,626,926 | A | * | 5/1997 | Roberts | 428/14 |
| 5,651,221 | A | * | 7/1997 | Golen | 52/202 |
| 5,787,642 | A | * | 8/1998 | Coyle et al. | 49/61 |
| 5,832,666 | A | * | 11/1998 | Flack et al. | 49/67 |
| 5,996,292 | A | | 12/1999 | Hill et al. | |
| 6,079,475 | A | * | 6/2000 | Morgan et al. | 160/371 |
| 6,109,331 | A | * | 8/2000 | Story, Jr. | 160/371 |
| 6,176,050 | B1 | | 1/2001 | Gower | |
| 6,230,455 | B1 | * | 5/2001 | Arehart et al. | 52/202 |
| 6,263,949 | B1 | | 7/2001 | Guthrie, Jr. | |
| 6,341,455 | B1 | | 1/2002 | Gunn | |
| 6,345,476 | B1 | * | 2/2002 | Hill | 52/202 |
| 6,745,515 | B1 | * | 6/2004 | Chen | 49/169 |
| 6,814,127 | B2 | | 11/2004 | Tagtow et al. | |
| 7,134,254 | B1 | * | 11/2006 | Van Gelder | 52/793.1 |
| 2006/0010792 | A1 | | 1/2006 | Biggers | |

FOREIGN PATENT DOCUMENTS

| | | |
|---|---|---|
| JP | 2000110465 | 4/2000 |

* cited by examiner

PORTABLE HURRICANE AND SECURITY WINDOW BARRIER

RELATED APPLICATION

This application claims the benefit of U.S. Provisional Application No. 60/857,863, filed on Nov. 10, 2006. The entire teachings of the above application are incorporated herein by reference.

BACKGROUND

Strong winds from hurricanes or tropical storms carry debris, which can cause heavy damage to windows and glass doors. Building owners typically cover windows and doors when a hurricane or tropical storm approaches with a barrier to prevent debris from hitting the glass surfaces. In the past, these barriers have either been disposable (e.g., plywood) or unsightly (e.g., a rollaway or slideaway screen permanently mounted to the door or window).

SUMMARY

Embodiments of the invention feature a portable, quick mounting, easily removable, and convenient-to-store security barrier that can protect an opening to a building, such as a window or sliding glass door, from breakage due to the hazard of flying debris caused by powerful winds generated by hurricanes and tornadoes. In conjunction with these catastrophes, an advantage of the invention is that is also offers a security benefit as a deterrent to home invasion by restricting breaking and entering through windows or sliding glass doors.

An embodiment of the invention comprises multiple panels that can be nested together when stacked for storage. The panels are easily and quickly installed and removed from a building window or other opening. In some embodiments, the panels are installed by inserting one end into slots attached to the building and installing the other end via anchoring bolts to a surface of the building. The panels may install in the slots via pins attached to the panels and the anchoring bolts may pass through the flanges on an opposite side of each panel. In some embodiments, the panels may be connected together via flanges and pins, such as clevis pins.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

Figure 1:
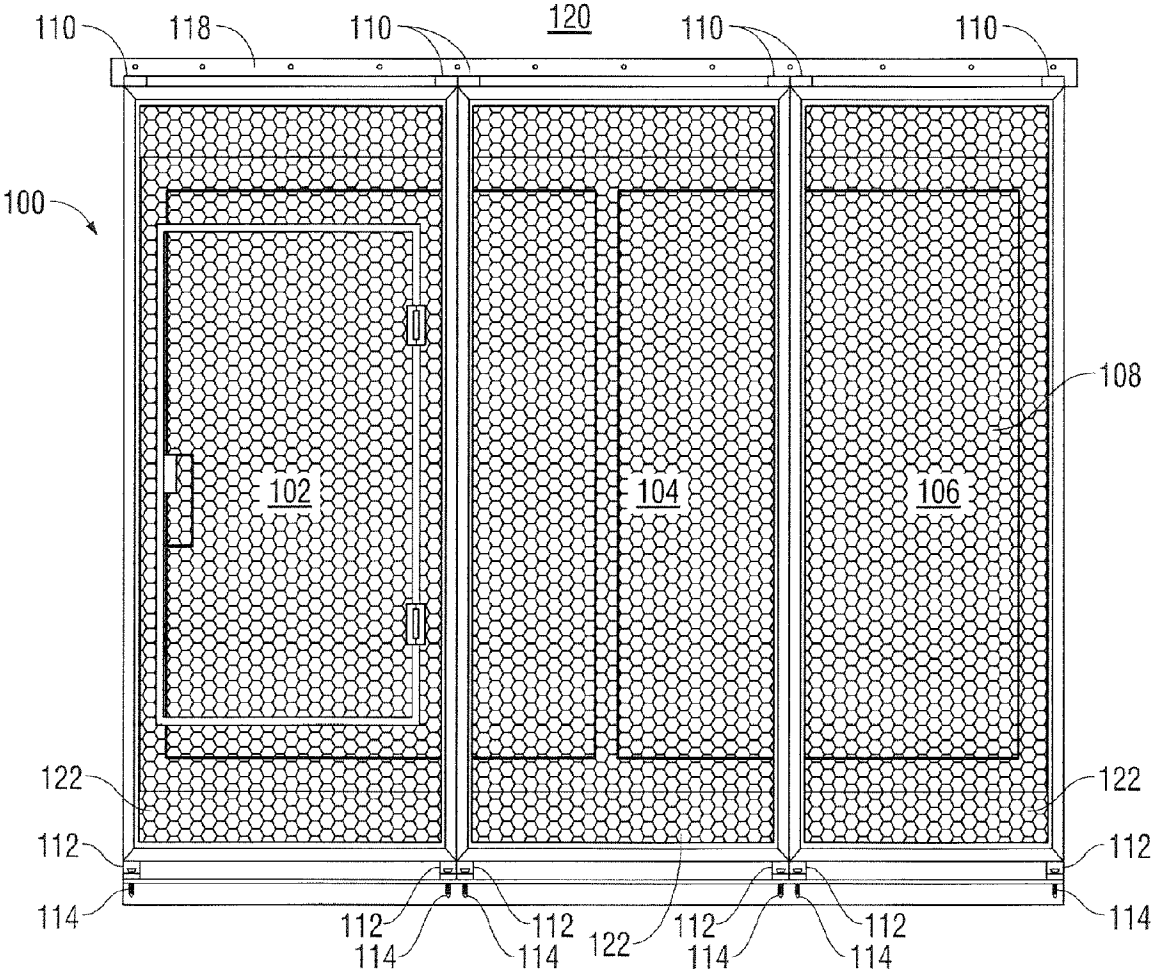
FIG. 1 illustrates an embodiment in which three panels are installed in front of a sliding door of a building.

FIG. 1 illustrates one embodiment of the present invention 100 in an installed configuration. In this embodiment, three panels 102, 104, 106 cover a sliding glass door 108 when installed. Each panel 102, 104, 106 includes a rectangular frame with a screen 122 covering the open area inside the frame. Each panel has a pair of pins 110 at the ends of a top side and a pair of anchoring flanges 112 at the ends of a bottom side. The pins 110 interface with a rail 118 installed in the wall 120 above the sliding door 108 and the anchoring feet interface with the ground 116 via bolts 114. Note that the panels 102, 104, 106 may alternatively be installed with the pins 110 (and rail 118) at the bottom and the anchoring flanges 112 and bolts 114 at the top being installed in the wall 120 of the building. While the embodiment shown in FIG. 1 has three panels, other embodiments may have a fewer or greater number of panels.

Each of the panels may be constructed from a number of materials, such as high-impact plastic, aluminum, steel or stainless steel, or a combination of materials. Materials that offer high strength and relatively low weight are preferable, but not required.

Figure 2A:
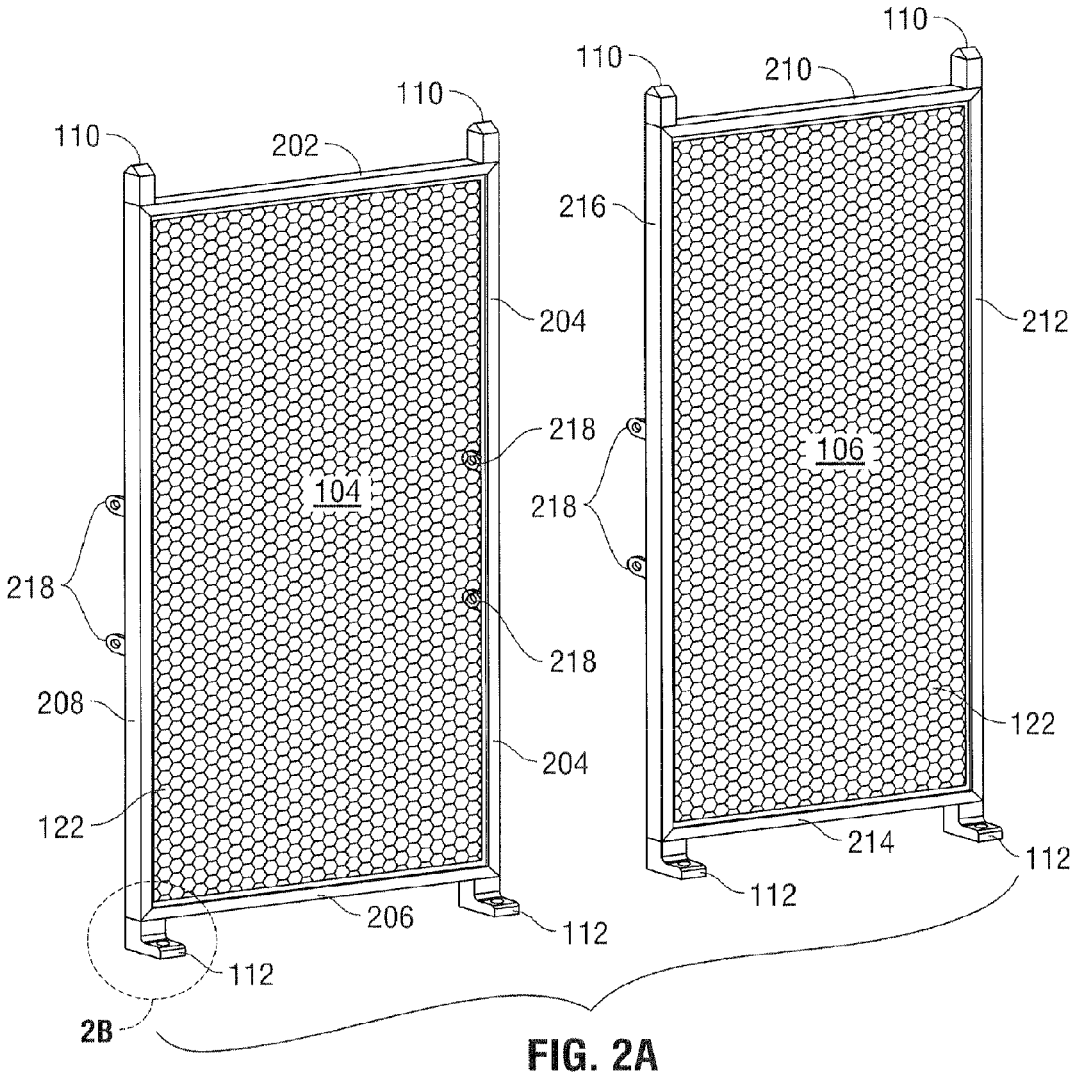
FIG. 2A shows two panels of the embodiment of FIG. 1 in a perspective view.
Figure 2B:
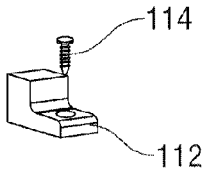
FIG. 2B shows an enlarged view of a panel foot of the embodiment of FIG. 2A.

FIG. 2A illustrates panels 104, 106 in accordance with an embodiment of the present invention in perspective view. As can be seen, the pins 110 extend directly above each panel 104, 106 on frame elements 202 and 210. The anchoring feet 112, enlarged in FIG. 2B, extend from each panel 104, 106 on the opposite frame elements 206 and 214. The anchoring feet 112, however, extend out to the side of each panel 104, 106. In this embodiment, the anchoring feet 112 extend from each panel 102, 104, 106. Panels 104 and 106 in this embodiment also have optionally included locking flanges 218 on frame elements 204, 208, and 216. The locking flanges 218 are connected via pins, such as clevis pins, or bolts (not shown) after the panel pins 110 and anchoring flanges 112 have been installed. Two locking flanges 218 between each panel are shown in this embodiment, but more or fewer flanges may be used.

Figure 3A:
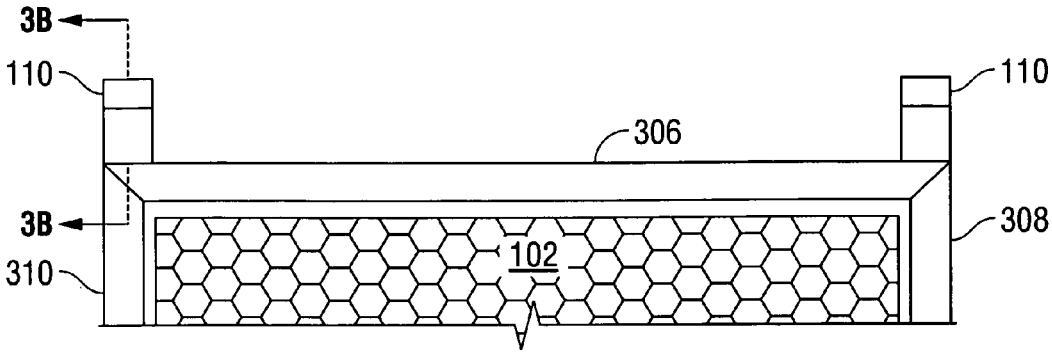
FIGS. 3A-3B show the top portion of a panel and a side view of a pin of the embodiment of FIG. 1.
Figure 3B:
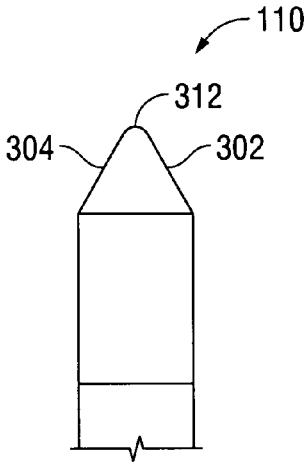

FIG. 3A illustrates pins 110 of panel 102 in accordance with an embodiment of the present invention. FIG. 3B shows that each pin 110 of the embodiment has a triangular cross-section with angled faces 302 and 304. The angled faces 302 and 304 converge at an apex 312.

Figure 4A:
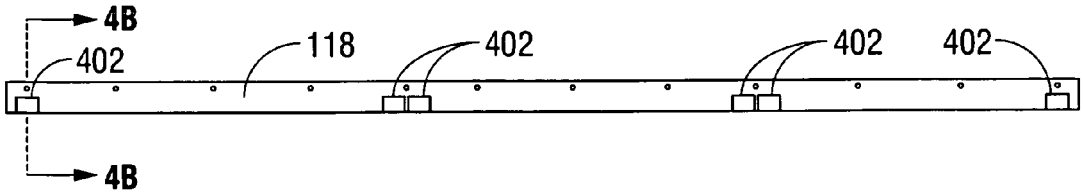
FIGS. 4A-4C illustrate a slotted rail according to the embodiment of FIG. 1.
Figure 4B:
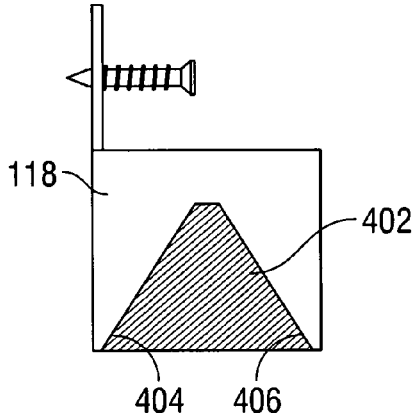
Figure 4C:
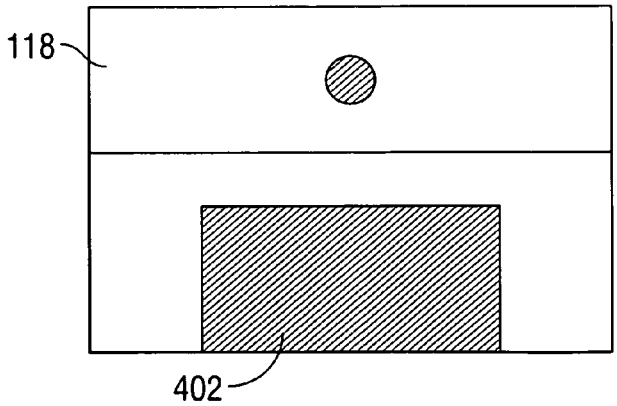

FIGS. 4A-4C illustrate the rail 118 with slots 402 in accordance with an embodiment of the present invention. The rail 118 has slots 402, which have angled faces 404 and 406, which match the angled faces 304 and 306 of the pins 110.

The angled faces 302, 304, 404, and 406 firmly hold the pins 110 in the slots 402 when the pins 110 are fully inserted in the slots 402. However, the angled faces 302, 304, 404, and 406 also allow the panels 102, 104, 106 to be pivoted about the apex 312 of each pin 110 when the pins 110 are partially inserted in the slots 402.

FIGS. 4B and 4C illustrate a rail 118 made of solid material, wherein the slots 402 are formed by cutting out portions of the solid material. Alternatively, the rail 118 could be formed of a tubular material, such as a stainless steel or aluminum tube wherein the tube wall has a square cross-section. The slots 402 would be formed by cutting out portions of tube wall. The pins 110, in this alternative embodiment, would be inserted through the slots 402 and be contained within the hollow space of the tubular rail 118.

Figure 6A:
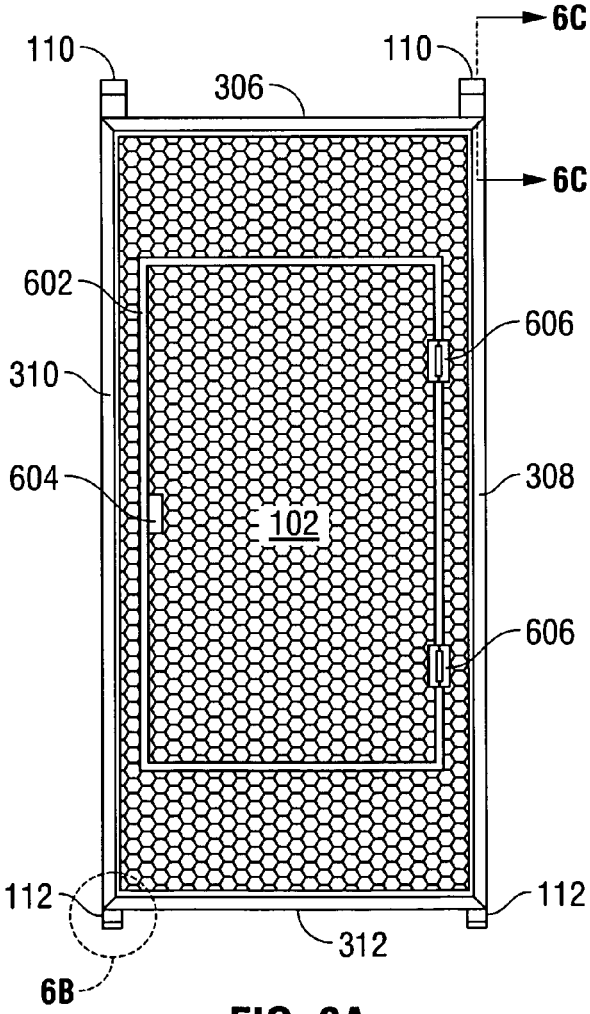
FIG. 6A illustrates an optional variation of the embodiment of FIG. 1 wherein one of the panels incorporates an escape door.
Figure 6B:
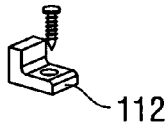
FIG. 6B shows an enlarged view of a panel foot of the embodiment of FIG. 6A.
Figure 6C:
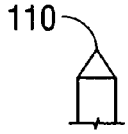
FIG. 6C shows an enlarged side view of a triangular wedge pin of the embodiment of FIG. 6A.

Returning to FIG. 2, since the anchoring flanges 112 and the locking flanges 218 extend from each panel 104 and 106, neatly stacking the panels would be difficult if the panels were all the same size because certain features that protrude from each panel 102, 104, 106, such as anchoring flanges 112, would interfere with each other, preventing the panels 102, 104, 106 from resting flat against each other. However, the three panels illustrated in the embodiment in FIG. 1 are each a different width. The top frame element 306 and bottom frame element 312 of the first panel 102 (as shown in FIG. 6) are longer than the top frame element 202 and bottom frame element 206 of the second panel 104 (as shown in FIG. 2), which are longer than the top frame element 210 and bottom frame element 214 of the third panel 106 (as shown in FIG. 2).

Figure 5:
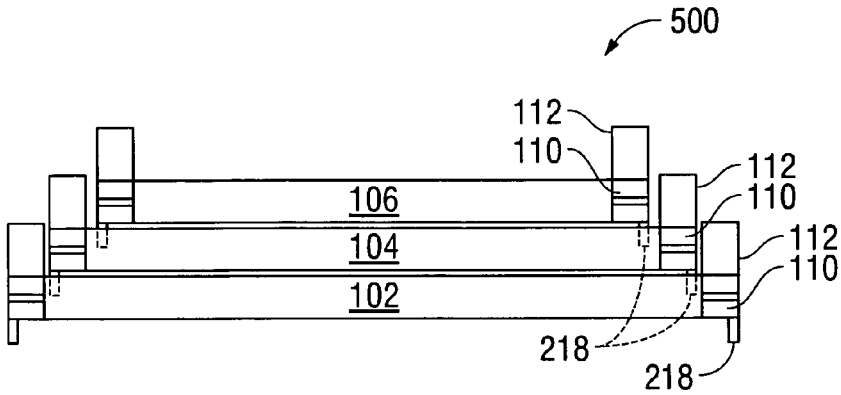
FIG. 5 illustrates the panels of the embodiment of FIG. 1 in an uninstalled and nested configuration for storage.

FIG. 5 illustrates the three panels 102, 104, 106 of the described embodiment stacked together in a nested configuration 500 for storage. Because panel 104 is narrower than panel 102, the anchoring flanges 112 of panel 104 are completely within the span between the anchoring flanges 112 of panel 102. Likewise, because panel 106 is narrower than panel 104, the anchoring flanges 112 of panel 106 are completely within the span between the anchoring flanges 112 of panel 104. Note that the panels' screens 122 (not shown in FIG. 5) must be set within each panel so that they do not interfere with the interlocking flanges 218 when the panels are nesting.

FIGS. 6A-C and 7 illustrate an escape door 602 that may be optionally installed in the above-described embodiment. The escape door 602 is best located in the largest panel 102, but may be located on any panel 102, 104, 106. The escape door 602 comprises its own frame with hinges 606 on one side and a locking latch 604 on the other side. The panel is illustrated as being located completely on the screen 122, but may also extend to the frame elements of the panel 102, 104, or 106 on which it is mounted. For example, the hinges 606 can be mounted to frame element 308 of panel 102 and the latch may interface with frame element 310.

Figure 7:
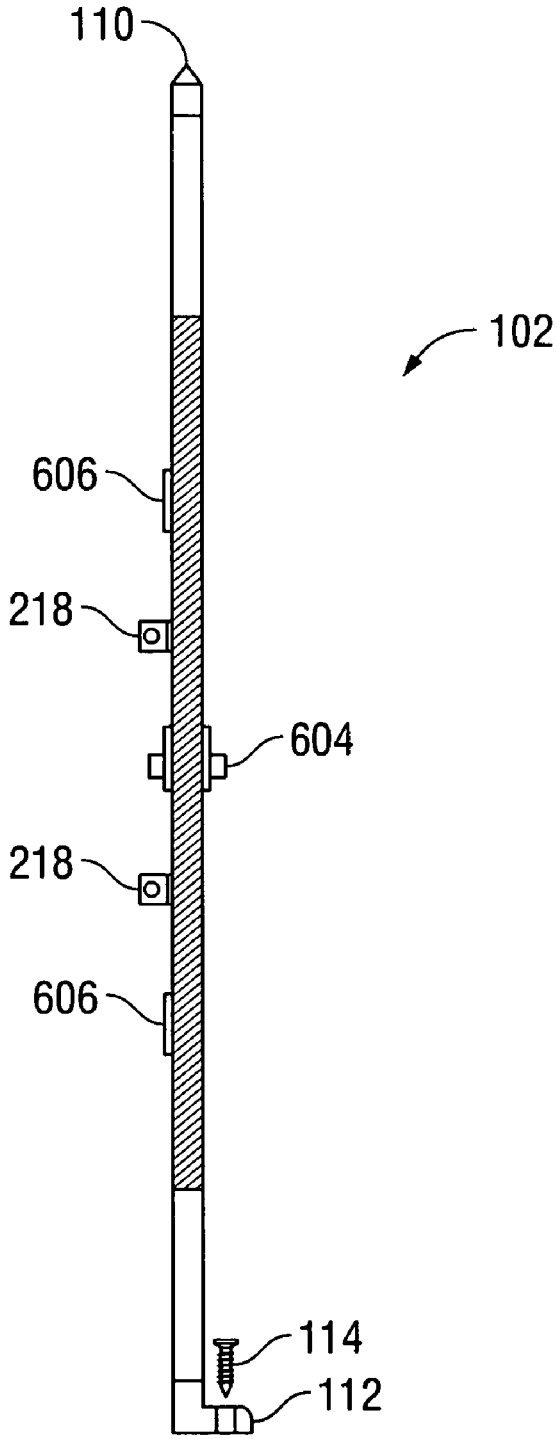
FIG. 7 illustrates a side view of the optional door shown in FIG. 6.

FIG. 7 also illustrates the anchoring flanges 112 attached to the bottom frame element of panel 102 in this embodiment. Bolts 114 extend through the portion of the anchoring flanges 112 extending from the panel. Optionally, the bolts may incorporate a security interface that requires a unique tool, such as a keyed wrench or screwdriver, to remove the bolts, thereby increasing the security provided by the screen.

Figure 10A:
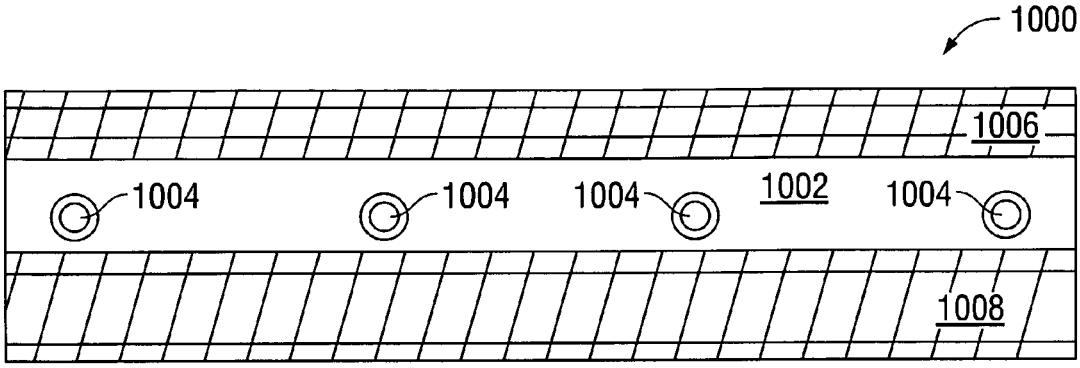
FIGS. 10A-10B illustrate a bracket plate of a third embodiment configured to be mounted to the side of a building.
Figure 10B:
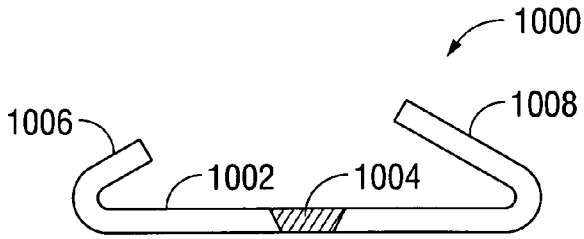

Typically, the anchoring flanges 112 would rest on a floor surface, such as a concrete slab, and the bolts would interface with corresponding holes in the floor surface. FIGS. 10A-B and 11A-B illustrate an alternative embodiment in which the anchoring flanges mount to a bracket. FIGS. 10A and 10B illustrate a bracket plate 1000 that would be permanently mounted above or below a window or a door. The bracket plate 1000 is mounted to the wall with screws or bolts (not shown) through holes 1004. The bracket plate has two flanges 1006, 1008. In the illustrated embodiment, flange 1008 is longer than flange 1006. However, flanges 1006, 1008 may be equal in size.

Figure 11A:
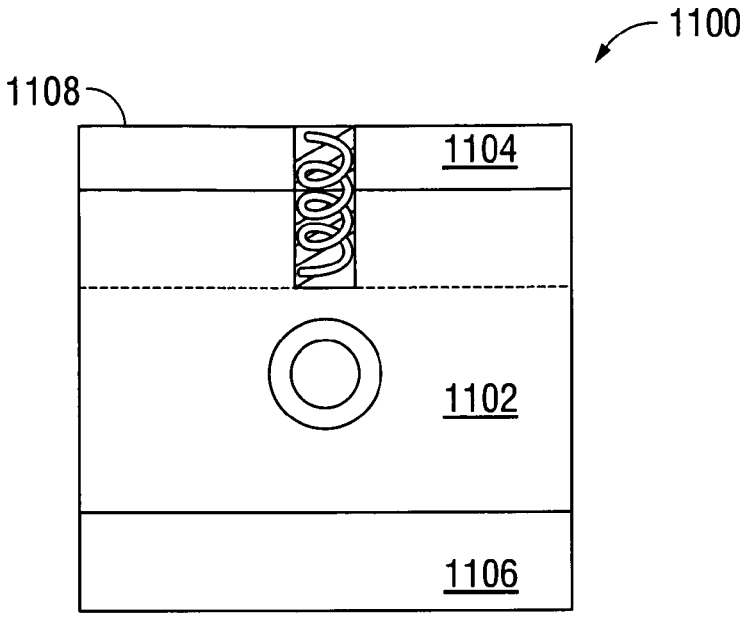
FIGS. 11A-11B illustrate a bracket of the embodiment of FIGS. 10A-10B that interfaces with the bracket plate.
Figure 11B:
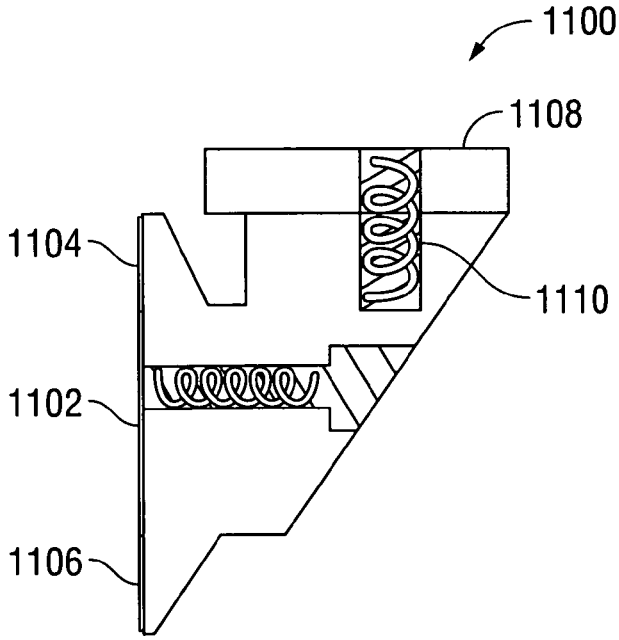

FIGS. 11A and 11B illustrate a bracket 1100 that interfaces with the bracket 1000 via slider plate 1102 and tabs 1104, 1106. Tab 1104 interfaces with flange 1006 and tab 1106 interfaces with flange 1008. The brackets 1100 slide in bracket plate 1000 to be positioned beneath anchoring flanges 112 of a panel. The flat surface of an anchoring flange 112 is then adjacent to plate 1108 of bracket 1100. Bolts 114 are passed through the anchoring flange 112 and into holes 1110 of bracket 1100. Such a bracket system, or an equivalent, allows a panel to be mounted at some height above the ground.

The embodiment described above with respect to FIGS. 10 and 11 illustrates a panel system in which the pins 110 are mounted above the opening to be protected and the anchoring flanges 112 are mounted below the opening. As mentioned earlier, the panels optionally can be mounted upside-down, wherein the pins 110 are mounted beneath the opening to be protected and the anchoring flanges 112 are mounted above the opening. In such an alternative embodiment, rail 118 is mounted below the opening. Pins 110 are located at the bottom of panels 102, 104, 106 and are lowered into slots 402. The panels 102, 104, 106 are then pivoted about the pins 110 to bring the anchoring flanges 112 into position for fastening to the building. In conjunction with the embodiment shown in FIGS. 10 and 11, the bracket plate 1000 and brackets 1100 can be located above the building opening to be protected and anchoring flanges 112 would bolt to the brackets 1100, which are located above. Alternatively, the anchoring flanges, in this embodiment, can be oriented such that they rest against the side of the building and bolt directly to an interface (not shown) mounted to the side of the building.

Figure 8:
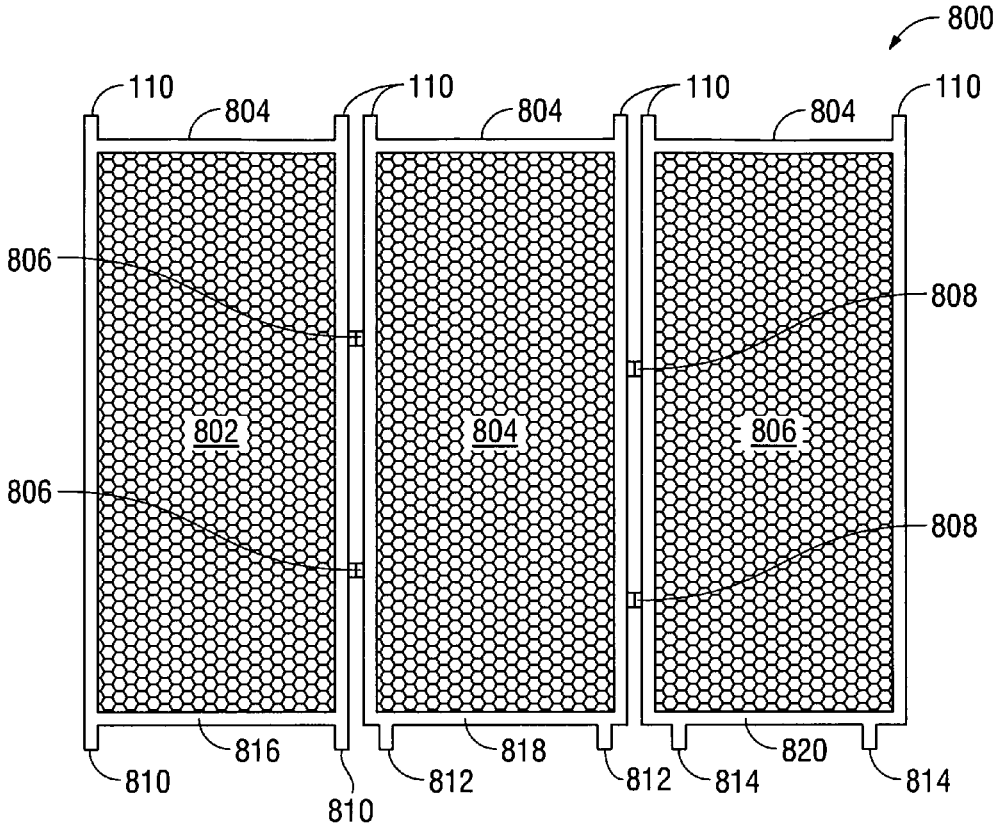
FIG. 8 illustrates a second embodiment in which three panels of equal width are installed in front of an opening of a building.
Figure 9:
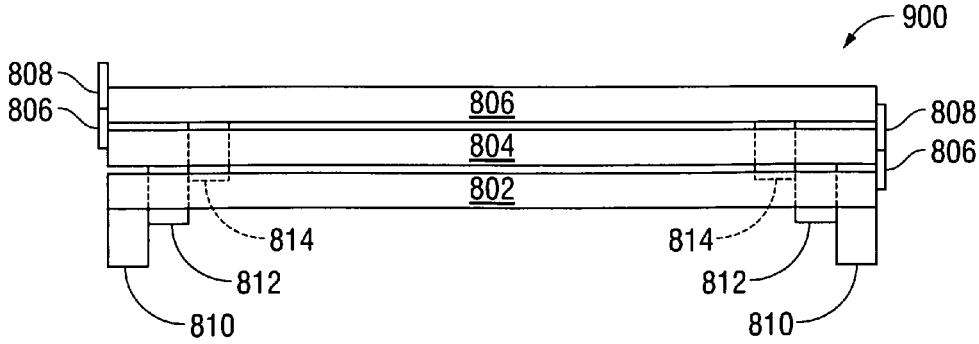
FIG. 9 illustrates the panels of the embodiment of FIG. 8 in an uninstalled and nested configuration for storage.

FIGS. 8 and 9 illustrate an alternative embodiment 800 of the present invention. Like the first embodiment described above, this embodiment utilizes three separate panels 802, 804, and 806. However, the three panels include identical dimensions of height and width. In this embodiment, the pins 110 are positioned in the ends of top frame elements 804 and the anchoring flanges 810, 812, and 814 are located on the opposite bottom frame elements 816, 818, and 820. However, the anchoring flanges 810, 812, and 814 are located at different positions on each panel 802, 804, and 806. On panel 802, the anchoring feet 810 are located at the ends of frame element 816. On panel 804, the anchoring feet 812 are located a distance inboard from the ends of frame element 818. On panel 806, the anchoring feet 814 are located a further distance inboard from the ends of frame element 820.

FIGS. 8 and 9 also show optionally-included locking flanges 806 and 808 which differ from the first embodiment in two ways. First, the flanges sit completely outside the perimeter of each panel 802, 804, and 806. Second, the locking flanges 806 and 808 vary in location between each panel. FIG. 8 shows locking flanges 806 between panels 802 and 804 and locking flanges 808 between panels 804 and 806. There are two locking flange pairs between each pair of panels. The locking flanges 806 between panels 802 and 804 are each higher than the respective locking flanges 808 between panels 804 and 806.

FIG. 9 shows that when panels 802, 804, and 806 are in a stacked configuration 900, they nest with the anchoring flanges 812 within anchoring flanges 810 and anchoring flanges 814 within anchoring flanges 812. The locking flanges 806 and 808 rest outside the perimeter of each panel 802, 804, 806. Also, because the locking flanges 806 and 808 are located on panels 802, 804, 806 at different heights, they do not interfere with each other when the panels 802, 804, and 806 are in the nested configuration 900.

While this invention has been particularly shown and described with references to example embodiments thereof, it will be understood by those skilled in the art that various changes in form and details may be made therein without departing from the scope of the invention encompassed by the appended claims.

What is claimed is:

1. An apparatus comprising:

a plurality of rectangular panels installable side by side to cover an opening of a building:

the first panel comprising a rectangular frame and a shielding material extending across the rectangular frame;

each subsequent panel comprising a rectangular frame and a shielding material extending across the rectangular frame, wherein each subsequent panel is narrower than a preceding panel such that the first and subsequent panels may be nested together when disassembled; and wherein each panel has two or more pins fixedly attached at ends of a first frame element and anchoring flanges attached at ends of a second frame element opposite the first frame element.

2. The apparatus of claim 1 wherein the shielding material of the plurality of rectangular panels is arranged as a honeycomb.

3. The system of claim 1 wherein the screening material of the plurality of rectangular panels is arranged as a solid sheet with a series of openings.

4. The apparatus of claim 1 wherein the shielding material of one of the plurality of rectangular panels includes a hinged portion configured to allow access to the opening of the building without removing the panel.

5. The apparatus of claim 1 wherein the shielding material and frame elements of the plurality of rectangular panels are made of at least one of:

aluminum;

stainless steel; and high-impact molded plastic.

6. The apparatus of claim 1 further comprising anchoring points fixed in relation to the building and configured to interface with the two or more anchoring flanges; and wherein the anchoring points interface with the two or more anchoring flanges by bolts fed through coaxially aligned holes in the anchoring points and the anchoring flanges.

7. The apparatus of claim 1 further comprising slots configured to interface with the two or more pins.

8. The apparatus of claim 7 wherein the slots are contained within a common rail mounted parallel to one edge of the opening of the building.

9. The apparatus of claim 7 wherein the two or more pins are tapered to allow the panels to pivot about the interface of the pins and the slots.

10. A system comprising:

a plurality of rectangular panels, which are installable adjacent to one another to cover an opening of a building, each panel including:

frame elements at the perimeter of each panel;

a screening material extending across the frame elements;

two or more pins fixedly attached to a first frame element;

two or more anchoring flanges fixedly attached to a second frame element opposite the first frame element; and the first and second frame elements of any panel having a different length from the remaining panels such that the panels may nest together when not installed.

11. The system of claim 10 wherein the screening material of the plurality of rectangular panels is arranged as a honeycomb.

12. The system of claim 10 wherein the screening material of the plurality of rectangular panels is arranged as a solid sheet with a series of openings.

13. The system of claim 10 wherein the screening material of one of the plurality of rectangular panels includes a hinged section configured to allow access to the building opening without removing the panel.

14. The system of claim 10 wherein the screening material and frame elements are made of at least one of:

aluminum;

stainless steel; and high-impact molded plastic.

15. The system of claim 10 further comprising anchoring points configured to interface with the two or more anchoring flanges of each panel.

16. The system of claim 15 wherein the anchoring points interface with the two or more anchoring flanges by bolts fed through coaxially aligned holes in the anchoring points and the anchoring flanges.

17. The system of claim 10 further comprising slots configured to interface with the two or more pins of each panel.

18. The system of claim 17 wherein the slots are within a common rail mounted parallel to one edge of the opening of the building.

19. The system of claim 17 wherein the two or more pins are tapered to allow the panels to pivot about the interface of the pins and the slots.

20. The system of claim 10, wherein each panel further includes one or more locking flanges fixedly attached to frame elements adjacent to frame elements of adjacent panels when the panels are installed.

* * * * *